US007225475B2

(12) United States Patent
Cho

(10) Patent No.: US 7,225,475 B2
(45) Date of Patent: Jun. 5, 2007

(54) HAT HAVING ELASTICITY AND METHOD OF MANUFACTURING THE SAME

(75) Inventor: Byoung-Woo Cho, Yongin (KR)

(73) Assignee: Yupoong, Inc., Seoul (KR)

( * ) Notice: Subject to any disclaimer, the term of this patent is extended or adjusted under 35 U.S.C. 154(b) by 0 days.

(21) Appl. No.: 11/227,487

(22) Filed: Sep. 16, 2005

(65) Prior Publication Data

US 2007/0083981 A1 Apr. 19, 2007

(51) Int. Cl.
*A42B 1/00* (2006.01)

(52) U.S. Cl. ..... 2/175.1; 2/209.12; 2/195.3; 2/175.2; 2/175.3; 2/175.5; 2/195.1; 2/195.7; 2/195.5; 2/200.3; 2/195.6; 2/12; 2/181; 2/183; 442/182; 442/183; 442/328; 442/389

(58) Field of Classification Search ..... 2/209.12, 2/195.3, 175.1, 175.2, 175.3, 175.5, 195.1, 2/195.7, 195.5, 200.3, 195.6, 12; 442/182, 442/183, 328, 389
See application file for complete search history.

(56) References Cited

U.S. PATENT DOCUMENTS 3,496,574 A * 2/1970 Liverant ..... 2/175.4
4,551,859 A * 11/1985 Gerhardt ..... 2/172
5,488,740 A * 2/1996 Garza ..... 2/175.1
5,832,537 A * 11/1998 Wakefield, III ..... 2/195.1
6,263,508 B1 * 7/2001 Davis ..... 2/10
6,314,582 B1 * 11/2001 Montague ..... 2/175.3
6,735,782 B2 * 5/2004 Park ..... 2/175.5
6,868,559 B1 * 3/2005 Wong ..... 2/195.3

* cited by examiner

*Primary Examiner*—Gary L. Welch
*Assistant Examiner*—Alissa Tompkins
(74) *Attorney, Agent, or Firm*—Staas & Halsey LLP

(57) ABSTRACT

Enhanced wearing comfort and a free-size feature of a hat may be achieved, without deteriorating exterior aesthetical features, when the hat includes a crown portion for being worn on a head of a wearer and an elastic brim formed by a plurality of fabric panels and combined to the crown portion, wherein the elastic brim includes a first fabric panel that is non-elastic and disposed as a most exterior panel among the plurality of fabric panels, a second fabric panel that is elastic and disposed as a most interior panel among the plurality of fabric panels, and sewing stitches combining the first and second fabric panels by sewing them along a circumferential direction in an outer portion of the elastic brim.

13 Claims, 3 Drawing Sheets

HAT HAVING ELASTICITY AND METHOD OF MANUFACTURING THE SAME

BACKGROUND OF THE INVENTION (a) Field of the Invention

The present invention relates to a hat having elasticity and a method of manufacturing the same. More particularly, the present invention relates to a hat having elasticity and a method of manufacturing the same having advantages of enhanced comfort and free-size feature without deteriorating exterior aesthetical features.

(b) Description of the Related Art

Typically, a hat, which has a brim, includes a crown portion for being worn on a head and a brim combined to a bottom edge of the crown portion. Structurally, such a hat can only show a very weak elasticity since the brim is combined to the bottom of the crown portion. In addition, when the brim is fabricated from a material having sufficient elasticity, exterior aesthetical features may be easily deteriorated since only limited types of materials may be used.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a hat having elasticity and a method of manufacturing the same having advantages of enhanced wearing comfort and free-size feature without deteriorating exterior aesthetical features.

An exemplary hat according to an embodiment of the present invention includes a crown portion for being worn on a head of a wearer and an elastic brim formed by a plurality of fabric panels and combined to the crown portion. Here, the elastic brim includes a first fabric panel that is non-elastic and is disposed as a most exterior panel among the plurality of fabric panels, a second fabric panel that is elastic and is disposed as a most interior panel among the plurality of fabric panels, and sewing stitches combining the first and second fabric panels by sewing them along a circumferential direction in an outer portion of the elastic brim.

The outer portion has a width more than about 40% of a total width of the elastic brim.

An elastic member may be interposed between the first and second fabric panels of the brim.

The crown portion may be combined to the first fabric panel.

An elastic band may be combined to the second fabric panel, and is preferably selected from a stretchable woven fabric, a stretchable non-woven fabric, or a knitted fabric.

The elastic member may include a non-woven fabric.

It may be preferable that only the first fabric panel is sewn by the sewing thread along the circumferential direction in the rest inner portion of the elastic brim.

An exemplary method of manufacturing a hat according to an embodiment of the present invention includes: exteriorly disposing a non-elastic fabric panel and interiorly disposing an elastic fabric panel; combining the non-elastic and elastic fabric panels by sewing them by a sewing thread in a circumferential direction in an outer portion that is apart from the crown portion by a predetermined distance in a width direction from the crown portion; and combining the crown portion to the non-elastic fabric panel and combining an elastic band to the elastic fabric panel.

The elastic fabric panel is preferably selected from a stretchable woven fabric, a stretchable non-woven fabric, or a knitted fabric.

The exemplary method may further include, interposing a brim lining between the non-elastic and elastic fabric panels before combining the non-elastic fabric panel and the elastic fabric panel.

DETAILED DESCRIPTION OF THE EMBODIMENTS

An exemplary embodiment of the present invention will hereinafter be described in detail with reference to the accompanying drawings.

Figure 1:
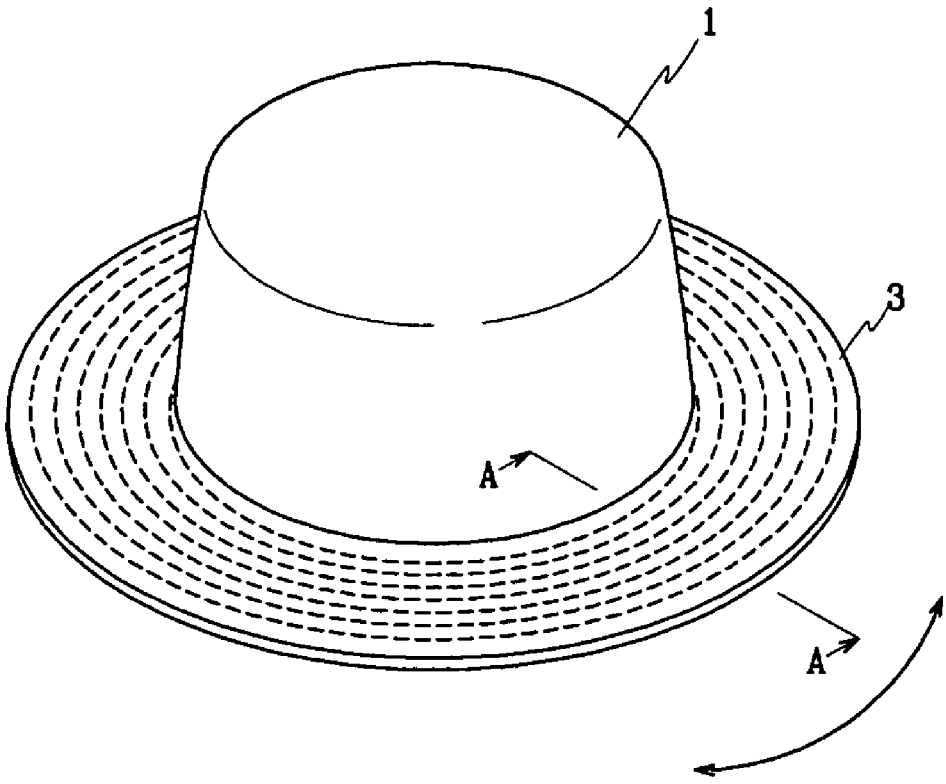
FIG. 1 is a perspective view of a hat according to an exemplary embodiment of the present invention.
Figure 2:
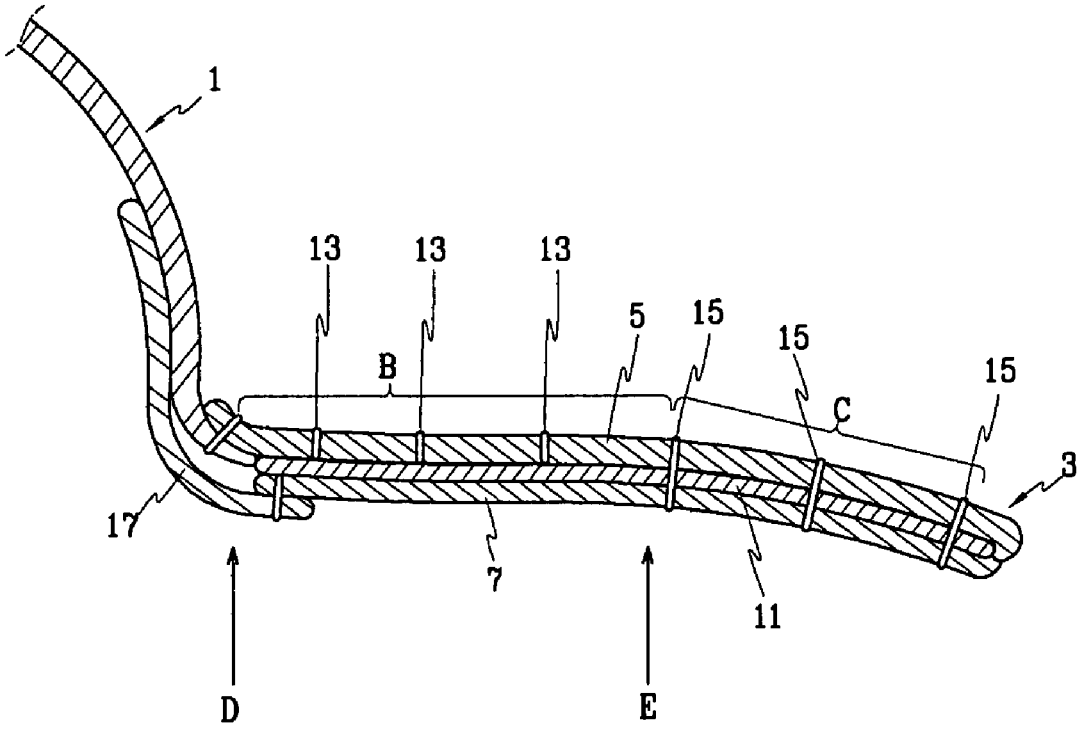
FIG. 2 is a cross-sectional view along the line A—A of FIG. 1.

FIG. 1 is a perspective view of a hat according to an exemplary embodiment of the present invention, and FIG. 2 is a cross-sectional view along the line A—A of FIG. 1. The hat according to an exemplary embodiment of the present invention includes a crown portion 1 for being worn on a head of a wearer, and a brim 3 combined to a bottom circumference of the crown portion 1.

The brim 3 includes a first fabric panel 5 exteriorly disposed (that is, located upward when the hat is worn) and a second fabric panel 7 interiorly disposed (that is, located downward when the hat is worn). In addition, the brim 3 may further include a brim lining 11 interposed between the first fabric panel 5 and the second fabric panel 7.

According to an exemplary embodiment of the present invention, the first fabric panel 5 of the brim 3 is formed of a non-elastic material. In this case, since the first fabric panel 5 is not elastic, cloths of various material having various decorations or patterns may be used as the first fabric panel 5 such that a variety of designs may also be applicable thereto, the same as in a conventional hat. Therefore, exterior aesthetical features may be maintained and not deteriorated in comparison with a conventional hat.

According to an exemplary embodiment of the present invention, the second fabric panel 7 of the brim 3 is formed of an elastic material. Such a second fabric panel 7 may enable the brim 3 to have elasticity in a circumferential direction thereof. Since the second fabric panel 7 has elasticity, wearing comfort may be enhanced, and in addition, a hat according to an exemplary embodiment of the invention may become free-sized. When a hat can be manufactured to be free-sized, productivity may be increased and stock may be managed at a low level since it is not necessary to manufacture hats of various sizes.

In addition, in order that high elasticity may be provided at the brim 3 in the circumferential direction, sewing in an inner portion B (refer to FIG. 2) is performed only for an exterior pattern, and sewing in an outer portion C is performed in the circumferential direction for combining the first and second fabric panels 5 and 7. That is, in the inner portion B of the brim 3 adjacent to the crown portion 1, sewing threads 13 only sew the first fabric panel 5 but not the second fabric panel 7. Therefore, the elasticity of the second fabric panel 7 is not degraded in the inner portion B, while a stitch pattern may still be exteriorly shown. In addition, in the outer portion C of the brim 3, sewing threads 15 sew the first and second fabric panels 5 and 7 in the circumferential direction to combine them to stably form the brim 3.

Meanwhile, the brim lining 11 in the brim 3 may be formed of an elastic material, for example, in the form of a non-woven fabric. It should not be understood that such a brim lining 11 is always necessary, since the brim lining 11 may be omitted depending on the case.

A width of the inner portion B where the sewing thread 13 only sews the first fabric panel 5 is preferably less than about 60% of a total width (that is, a sum of the portions B and C) of the brim 3. When the width of the inner portion B is more than about 60% of the total width of the brim 3, it may detrimentally result in a hardness of the brim, thereby causing a drawback of a deterioration of the quality of the goods. According to an exemplary embodiment of the present invention, the inner portion B is formed at a width of 10–50% of the total width of the brim 3. In such a width range of the inner portion B, it has been found that the brim shows good elasticity and the quality of goods is not deteriorated.

In addition, the second fabric panel 7 may further include an elastic band 17 disposed along an interior circumference of the hat to fit around the head of the wearer. A material having high elasticity, of which many typical examples may be found in the art, is used for the elastic band 17. Such an elastic band 17 is combined to the second fabric panel 7 and it may provide sufficient elasticity to vary a size of the interior circumference of the hat.

In addition, the crown portion 1 is combined to the first fabric panel 5 thereby forming an overall shape of the hat. That is, the crown portion 1 is combined to a panel (i.e., the first fabric panel 5) that is less important in the viewpoint of the elasticity of the hat in the circumferential direction of the head of the wearer.

Such a structured brim 3 may show higher elasticity in the circumferential direction at a point D near to the crown portion 1 than at a point E.

Therefore, such a hat may have enhanced elasticity in the circumferential direction, while allowing various materials and designs of cloths to be employed.

Figure 3:
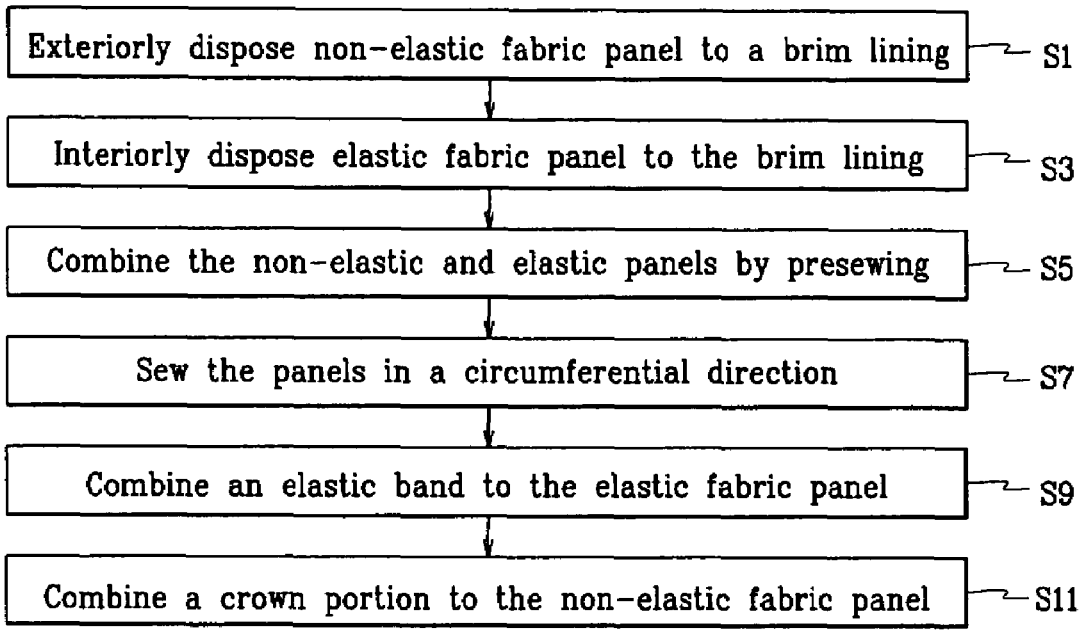
FIG. 3 is a flowchart showing a method of manufacturing a hat according to an exemplary embodiment of the present invention.

An exemplary method of manufacturing such a hat according to an embodiment of the present invention will be described in detail with reference to FIG. 3.

Firstly at step S1, the first fabric panel 5, which is a non-elastic fabric panel, is attached to the exterior of the brim lining 11. Subsequently at step S3, the second fabric panel 7, which is an elastic fabric panel, is disposed to the interior side of the brim lining 11. Then at step S5, the first fabric panel 5 and the second fabric panel 7 are coupled together by pre-sewing. At the steps S1 and S3, the brim lining 11 may be omitted and the first and second fabric panels 5 and 7 may be directly coupled by pre-sewing. Depending on the case, the pre-sewing may also be omitted.

Subsequently, at step S7, the first and second fabric panels 5 and 7 are sewn in the circumferential direction. The sewing of the first and second fabric panels 5 and 7 in the circumferential direction is performed only in the outer portion C (refer to FIG. 2) that is apart from the crown portion 1 by a predetermined distance (a distance corresponding to the inner portion B shown in FIG. 2). Here, the portion B of the brim 3 in FIG. 2 may be separately sewn or stitched for exterior aesthetical features.

When the brim 3 is finished at step S7, the elastic band 17 is combined to the second fabric panel 7 by the sewing thread 15 at step S9. Then at step S11, the crown portion 1 is combined to the first fabric panel 5. It is notable that the steps S9 and S11 may be executed in the opposite order.

As described above, according to an exemplary embodiment of the present invention, a non-elastic fabric panel is disposed upward at a brim so as to enhance exterior aesthetical features, and an elastic fabric panel is disposed downward at the brim. Therefore, according to an exemplary embodiment of the present invention, elasticity of the brim may be enhanced at a inner portion near the crown portion thereby providing good wearing comfort, without deteriorating exterior aesthetical features. In addition, a hat may be manufactured to be free-sized by such a structure of the hat. Therefore, productivity may be increased and stock may be managed at a low level, since it is not necessary to manufacture hats of various sizes.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A hat, comprising:

a crown portion for being worn on a head of a wearer, and an elastic brim formed by a plurality of fabric panels and combined to the crown portion, wherein the elastic brim comprises:

a first fabric panel that is non-elastic and is disposed as a most exterior panel among the plurality of fabric panels;

a second fabric panel that is elastic and is disposed as a most interior panel among the plurality of fabric panels;

a first plurality of sewing stitches combining the first and second fabric panels by sewing along a circumferential direction only in an outer radial portion of the elastic brim; and a second plurality of sewing stitches stitching only the first fabric panel in an inner radial portion of the elastic brim.

2. The hat of claim 1, wherein the outer portion has a width more than about 40% of a total width of the elastic brim.

3. The hat of claim 1, wherein an elastic member is interposed between the first and second fabric panels of the brim.

4. The hat of claim 1, wherein the crown portion is combined with the first fabric panel and is not combined with the second fabric panel.

5. The hat of claim 1, further comprising an elastic band having a fixed end portion combined with the second fabric panel and a free end opposite the crown portion.

6. The hat of claim 3, wherein the elastic member comprises a non-woven fabric.

7. The hat of claim 1, wherein, the second fabric panel is selected from a stretchable woven fabric, a stretchable non-woven fabric, or a knitted fabric.

8. A hat, comprising:

a crown portion for being worn on a head of a wearer; and an elastic brim formed by a plurality of fabric panels and combined to the crown portion, wherein the elastic brim comprises:

a first fabric panel that is non-elastic and is disposed as a most exterior panel among the plurality of fabric panels, the first fabric panel being combined to the crown portion;

a second fabric panel that is elastic and is disposed as a most interior panel among the plurality of fabric panels;

first sewing stitches combining the first and second fabric panels by sewing them along a circumferential direction only in an outer radial portion of the elastic brim, the outer portion having a width more than about 40% of a total width of the elastic brim;

second sewing stitches sewing only the first fabric panel along the circumferential direction in an inner radial portion of the elastic brim;

an elastic member interposed between the first and second fabric panels of the brim; and an elastic sweatband combined to the second fabric panel.

9. The hat of claim 8, wherein the elastic member comprises a non-woven fabric.

10. The hat of claim 8, wherein the second fabric panel is selected from a stretchable woven fabric, a stretchable non-woven fabric, or a knitted fabric.

11. The hat of claim 8, wherein the elastic band is selected from a stretchable woven fabric, a stretchable non-woven fabric, or a knitted fabric.

12. A method of manufacturing a hat, comprising:

exteriorly disposing a non-elastic fabric panel and interiorly disposing an elastic fabric panel;

combining the non-elastic and elastic fabric panels by sewing them by a sewing thread in a circumferential direction in only an outer radial portion that is apart from the crown portion by a predetermined distance in a radial direction from the crown portion; and combining the crown portion to the non-elastic fabric panel and combining an elastic band to the elastic fabric panel.

13. The method of claim 12, further comprising, before combining the non-elastic fabric panel and the elastic fabric panel, interposing a brim lining between the non-elastic and elastic fabric panels.

* * * * *